US010426224B2

(12) United States Patent
Lucca

(10) Patent No.: US 10,426,224 B2
(45) Date of Patent: Oct. 1, 2019

(54) THREE LAYER SHOE CONSTRUCTION WITH IMPROVED CUSHIONING, BREATHABILITY, FLEXIBILITY AND WATER DISPLACEMENT

(71) Applicant: Footwear Unlimited Inc., Fenton, MO (US)

(72) Inventor: Fabio Lucca, Valley Park, MO (US)

(73) Assignee: Footwear Unlimited Inc., Fenton, MO (US)

( * ) Notice: Subject to any disclaimer, the term of this patent is extended or adjusted under 35 U.S.C. 154(b) by 210 days.

(21) Appl. No.: 15/693,632

(22) Filed: Sep. 1, 2017

(65) Prior Publication Data

US 2019/0069634 A1 Mar. 7, 2019

(51) Int. Cl.

| | |
|---|---|
| ***A43B 5/00*** | (2006.01) |
| ***A43B 13/00*** | (2006.01) |
| ***A43B 13/14*** | (2006.01) |
| ***A43B 13/12*** | (2006.01) |
| ***A43B 7/14*** | (2006.01) |
| ***A43B 13/18*** | (2006.01) |
| ***A43B 1/00*** | (2006.01) |
| ***A43B 13/04*** | (2006.01) |
| ***A43B 13/38*** | (2006.01) |

(52) U.S. Cl.

CPC ..... *A43B 13/186* (2013.01); *A43B 1/0045* (2013.01); *A43B 7/142* (2013.01); *A43B 13/04* (2013.01); *A43B 13/122* (2013.01); *A43B 13/125* (2013.01); *A43B 13/141* (2013.01); *A43B 13/188* (2013.01); *A43B 13/38* (2013.01)

(58) Field of Classification Search

CPC ..... A43B 13/189; A43B 13/04; A43B 13/122; A43B 13/125; A43B 13/141; A43B 13/188; A43B 13/38; A43B 13/40; A43B 1/0045; A43B 7/141; A43B 7/142

USPC ..... 36/28, 25 R, 30 R, 88

See application file for complete search history.

(56) References Cited

U.S. PATENT DOCUMENTS

| | | | |
|---|---|---|---|
| 1,568,064 | A | 1/1926 | Goldman |
| 4,641,438 | A | 2/1987 | Laird et al. |
| 4,794,707 | A | 1/1989 | Franklin et al. |
| 4,866,861 | A | 9/1989 | Noone |
| 4,942,679 | A | 7/1990 | Brandon et al. |
| 5,224,277 | A | 7/1993 | Sang Do |
| 5,353,526 | A | 10/1994 | Foley et al. |

(Continued)

*Primary Examiner* — Jameson D Collier

(74) *Attorney, Agent, or Firm* — Husch Blackwell LLP

(57) ABSTRACT

A shoe construction including an outsole having a first section which includes portions of the forefoot and midfoot areas, a second section which includes portions of the forefoot, midfoot and hind foot areas, and a third section which includes portions of the midfoot and hind foot areas, the first and third sections including a plurality of curved and straight grooves and the second section including a plurality of diagonal grooves, the outsole further including a cavity, raised projections and a pair of protrusions for mating with a projected area and corresponding grooves and recesses on the midsole when the outsole and midsole are mated together, the midsole having a first density in the forefoot area and a second density in the hind foot area, the proximal face of the midsole including a second cavity for receiving the insole, the insole having a top face including a plurality of raised projections.

20 Claims, 5 Drawing Sheets

(56) References Cited

U.S. PATENT DOCUMENTS

| | | | | |
|---|---|---|---|---|
| 5,400,526 | A * | 3/1995 | Sessa | A43B 1/0045 36/141 |
| 6,038,790 | A | 3/2000 | Pyle et al. | |
| 6,061,929 | A | 5/2000 | Ritter | |
| 6,161,315 | A | 12/2000 | Dalton | |
| 6,276,073 | B1 | 8/2001 | Curley, Jr. | |
| 6,705,027 | B1 | 3/2004 | Campbell | |
| 6,817,117 | B1 | 11/2004 | Campbell | |
| 6,857,202 | B2 * | 2/2005 | Pfander | A43B 1/0009 36/28 |
| 7,610,695 | B2 | 11/2009 | Hay | |
| 7,637,034 | B2 | 12/2009 | Ailey et al. | |
| 10,231,512 | B2 * | 3/2019 | Lucca | A43B 1/0045 |
| 10,231,513 | B1 * | 3/2019 | Lucca | A43B 7/142 |
| 10,238,174 | B2 * | 3/2019 | Lucca | A43B 17/00 |
| 2002/0004999 | A1 | 1/2002 | Caine et al. | |
| 2002/0078598 | A1 | 6/2002 | Bell | |
| 2004/0103559 | A1 * | 6/2004 | Pfander | A43B 7/144 36/44 |
| 2005/0268490 | A1 * | 12/2005 | Foxen | A43B 7/1425 36/28 |
| 2007/0277401 | A1 | 12/2007 | Young-Chul | |
| 2009/0090031 | A1 | 4/2009 | Jung | |
| 2009/0188131 | A1 | 7/2009 | Doerer et al. | |
| 2009/0307932 | A1 | 12/2009 | Kirby et al. | |

* cited by examiner

THREE LAYER SHOE CONSTRUCTION WITH IMPROVED CUSHIONING, BREATHABILITY, FLEXIBILITY AND WATER DISPLACEMENT

FIELD OF THE INVENTION

The present invention relates to a shoe construction and, more particularly, to a three layered shoe construction with an outsole having a unique exterior face pattern to enhance flexibility, comfort and water displacement, a dual density midsole, and an insole having a distinctive bubble type pattern for increased breathability, air circulation, and cushioning coupled with a molded arch area for providing additional support to the arch of the foot.

BACKGROUND OF THE INVENTION

Numerous shoes covering a broad range of different designs and styles have been manufactured and sold in the marketplace. While shoes are worn to provide protection to one's feet, to reduce the impact felt when walking on hard surfaces, to provide support for the feet, and to prevent pronation, shoe designers must still seek to provide optimum levels of stability and comfort. In order to accomplish all of these objectives, shoe designers have used a wide variety of different tools and methods including heel plugs, shanks, contoured soles, deformable pillars or columns, spring-like structures, different traction designs, cushioning members, different shank designs, different ventilation structures, rocker elements, pads, gels and sole constructions having a plurality of different layers. Although these methods can be effective, the large number of components can result in increased manufacturing costs and complexity. It is therefore desirable to improve cushioning, flexibility, support and stability without increasing the number of components to achieve the same level of comfort for the user.

SUMMARY OF THE INVENTION

The present invention is directed to a three layer shoe construction which includes an outsole, midsole, and insole. The three layers have a mating relationship which will be later described in detail. The three components of the present shoe are preferably secured together through conventional means such as through cementing and/or adhesives thereby preventing relative movement between the layers during assembly and use of the present shoe. Each of the three layers of the present shoe are generally in the shape of a human foot and can be divided into different sections according to the three different regions of the human foot—the forefoot, the midfoot, and the hind foot. The forefoot is generally adjacent to and includes the toe area; the hind foot is generally adjacent to and includes the heel area; and the midfoot is located adjacent to both the forefoot and the hind foot. The ball of the foot is generally the area of the foot at the juncture between the metatarsal bones and the phalange bones. The two primary regions of the foot for load bearing when walking or standing normally are the ball area and the heel area, and the major bending of the shoe during normal use is typically in the ball area. The arch or instep is positioned between the heel and ball areas and flexes very little when walking normally.

The present outsole is made out of a super lightweight thermoplastic rubber (TPR) and includes an exterior and interior face. The exterior face of the present outsole engages the ground or other walking surfaces, while the interior face is located opposite the exterior face and has a mating relationship with the midsole as will be hereinafter further described in more detail.

The exterior face of the outsole includes a first, second, and third section. The first section includes portions of the forefoot and midfoot areas. In one embodiment, the first section includes the majority of the forefoot area (the proximal side being a medical side) and extends from the proximal side of the forefoot area to the distal side of the midfoot area (the distal side being a lateral side). The first section further includes a plurality of curved or non-linear grooves, some of which intersect with a plurality of straight grooves. Circular shaped apertures or cavities are also provided in the first section to provide extra flexibility, traction, and comfort. Some of the curved grooves start out extending substantially along the longitudinal axis before curving towards the proximal side of the outsole and at least one of the curved grooves then continues to curve back towards the distal side of the outsole. Others extend from the proximal side towards the distal side. At least one of the plurality of straight grooves extends largely along the longitudinal axis, while the remainder of the first plurality of straight grooves extend in a direction so as to intersect with a portion of the plurality of curved grooves. The first section is divided from the second section by a first angled groove.

The second section includes portions of the forefoot, midfoot, and hind foot areas. More specifically, the second section includes the majority of the midfoot area and extends from the midfoot area towards and into the proximal side of the forefoot area and also extends in an opposite direction towards and into the distal side of the hind foot area. The second section further includes a first series of diagonal grooves and a second series of diagonal grooves. The first series of diagonal grooves is located approximately throughout the entirety of the second section and extends from the distal side towards the proximal side forming an obtuse angle with the longitudinal axis. The second series of diagonal grooves is located and positioned at the distal side of the second section and are positioned at a different angle as compared to the first series of diagonal grooves. The second section is divided from the third section by a first non-linear groove which extends from the heel area to the proximal side of the midfoot area.

The third section includes portions of the hind foot and midfoot areas and is located approximately in the hind foot area and extends towards and into the midfoot area. Similar to the first section, the third section further includes a plurality of curved grooves which intersect with a second plurality of straight grooves, wherein the plurality of curved grooves extend from the midfoot area into the hind foot area largely following the curve of the first non-linear groove, and the second plurality of straight grooves extend from the proximal side of the heel area towards the distal side. The intersection of the plurality of curved grooves and second plurality of straight grooves create a plurality of raised areas wherein each raised area includes a circular shaped aperture or cavity.

The outsole further includes a sidewall having a raised lip or edge portion which extends around the entirety of its perimeter forming a first cavity on the interior face of the outsole substantially in the same shape as the outsole. The sidewall of the outsole also includes two protrusions which extend upwards towards the midsole such that the two protrusions have a greater height than the remainder of the edge portion of the sidewall thereby increasing stability and support when mated with the midsole. The outsole sidewall further includes a plurality of triangularly shaped raised projections located and positioned in the forefoot and hind foot areas which provide additional support and strength.

The outsole has a mating relationship with the midsole, which will be hereinafter further explained. The interior face of the outsole further includes raised projections corresponding to the first angled groove separating the first section and second section (raised angled projection) and the first non-linear groove separating the second section from the third section on the exterior face of the outsole (raised non-linear projection). The interior face of the outsole also includes a third raised oval shaped projection located and positioned in the midsole area of the outsole between the raised angled projection and raised non-linear projection. The angled raised projection and non-linear raised projection allow for the exterior face of the outsole to have deeper grooves which function in conjunction with the plurality of curved and straight grooves associated with the first, second and third sections of the outsole to help displace water when walking on wet surfaces. The plurality of grooves and cavities create fluid flow channels to help guide water or other liquids off the outer surface of the outsole thereby preventing the outer surface from becoming slippery. The plurality of grooves also increases flexibility in the outsole.

The present midsole is made of a dual density blown ethylene-vinyl acetate copolymer (EVA) with an intrinsic molded arch support which supports the arch of the foot. The EVA creates a lightweight and resilient midsole which helps dissipate shock when walking or running. In addition to the material itself, the dual density of the midsole allows for greater flexibility and cushioning in the forefoot area due to its lighter density, and provides greater support and stability in the hind foot area due to its heavier density. The sidewall of the midsole includes a diamond-shaped scored pattern covering substantially the entire sidewall and a circumferentially extending ridge or edge portion where the midsole meets the outsole such that the raised lip on the outsole mates with the circumferentially extending ridge on the midsole when the outsole and midsole are coupled together. The scored pattern likewise helps to dissipate and absorb shock.

The midsole has a proximal and distal face. The distal face includes a protrusion or raised area substantially in the shape of the outsole and corresponds to the shape of the first cavity in the outsole. The distal face of the midsole further includes channels or grooves that correspond to the raised projections on the interior face of the outsole as well as a plurality of circular apertures or cavities and a plurality of raindrop shaped apertures or cavities for reducing the weight of the midsole and improving cushioning, flexibility, and creating a bounce effect. The midsole has a mating relationship with the outsole wherein the distal face of the midsole mates with and is received by the first cavity created by the sidewall on the interior face of the outsole. The insole also has a mating relationship to the midsole wherein the proximal face of the midsole has a lip or flange extending around its entire circumference creating a second cavity substantially in the shape of the insole. The insole mates with and is received by the second cavity of the midsole. The three layers are preferably secured together to prevent movement when worn.

The insole is a lightweight, thermal molded EVA with an antimicrobial shield which provides protection against bacteria, fungus, and controls or eliminates odors, stains, and product deterioration. This can be accomplished by adding a powder or other antimicrobial agents during the manufacturing process. The insole has a top face and a bottom face wherein the top face engages with the foot of a wearer and has a plurality of raised oval shaped projections that provide for a bubble type effect which enhances cushioning and air circulation when the shoe is worn. In one embodiment, the raised oval shaped projections cover the entire top face of the insole. The bottom face of the insole is smooth.

The present three layer shoe construction absorbs shock, enhances comfort, and creates a unique propulsion effect, without requiring a vast number of components.

BRIEF DESCRIPTION OF THE DRAWINGS

For a better understanding of the various embodiments of the present invention, reference may be made to the accompanying drawings in which.

Figure 1:
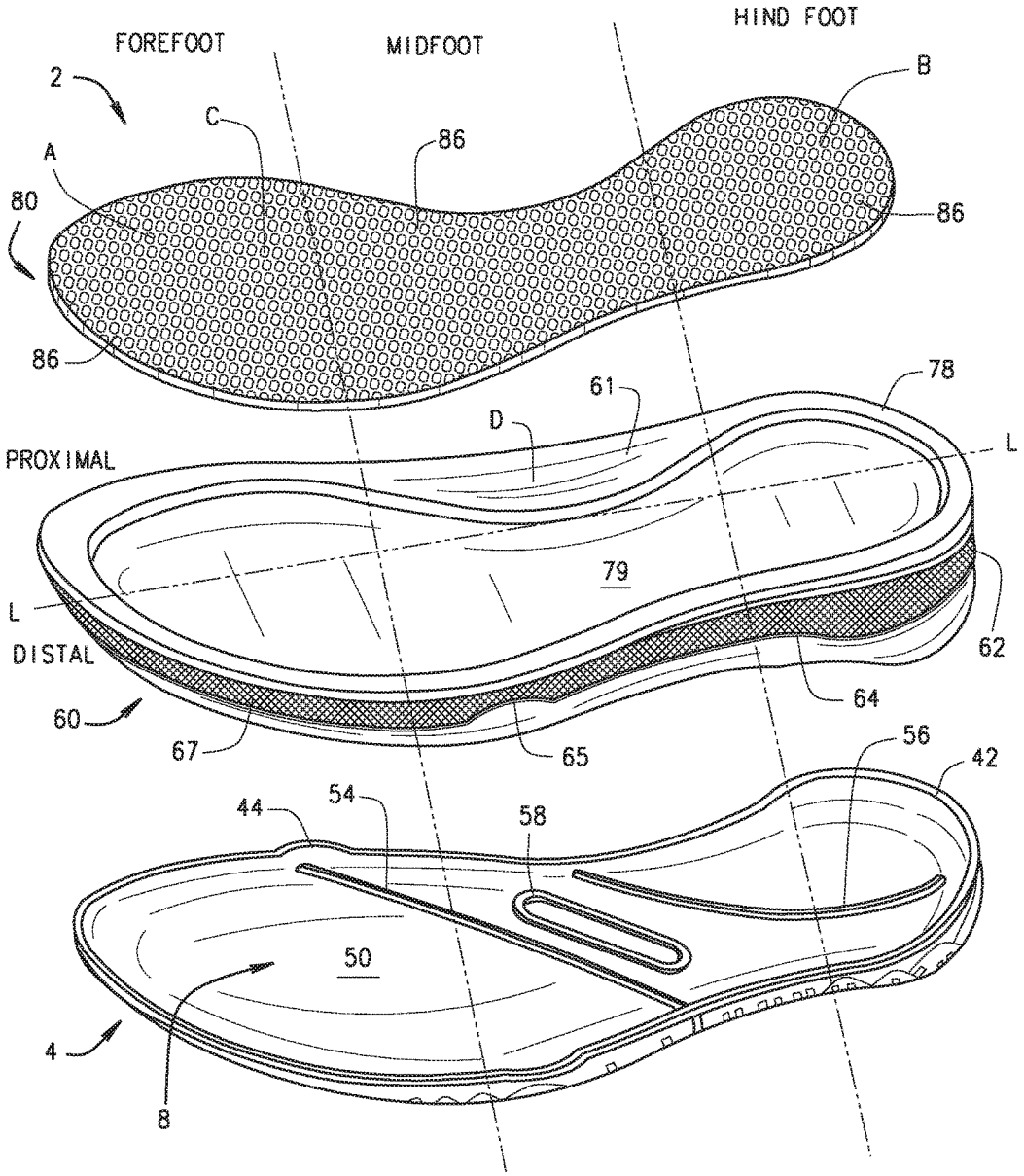
FIG. 1 is an exploded perspective view illustrating a shoe structure constructed according to the teachings of the present invention.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure.

DETAILED DESCRIPTION OF THE DRAWINGS

The invention will now be described with reference to the drawing figures in which like reference numerals refer to like parts throughout. For purposes of clarity in illustrating the characteristics of the present invention, proportional relationships of the elements have not necessarily been maintained in the drawing figures.

As illustrated in FIG. 1, a three layer shoe construction 2 constructed in accordance with the teachings of the present invention includes an outsole 4, a midsole 60, and an insole 80. The outsole 4, midsole 60, and insole 80 have a mating relationship to each other as will be hereinafter further described. The combination of the three layers provides a unique cushioning and energizing propulsion effect, giving the wearer a sense of bouncing off of the ground. The layers of the present shoe are preferably secured together in a conventional manner such as through cementing and/or adhesives thereby preventing relative movement between the layers during assembly and use of the present shoe.

Each of the three layers of the present shoe are generally in the shape of a human foot and can be divided into different sections according to three distinct regions of the human foot—the forefoot, midfoot, and hind foot. The forefoot area or region of the foot is approximately adjacent to and includes the toe area A, while the hind foot area or region of the foot is approximately adjacent to and includes the heel area B. The midfoot area or region is approximately adjacent to both the forefoot and hind foot regions as illustrated in FIG. 1 and includes the arch D. The ball area C of the foot is generally the area of the foot at the juncture between the metatarsal bones and the phalange bones. The two primary regions of the foot for load bearing when walking or standing normally includes the ball area C and the heel area B, and the major bending of the shoe during normal use is typically in the vicinity of the ball area C. The arch or instep area D is located between the heel area B and ball area C, and flexes very little when walking normally. The three layers of the present shoe also includes a longitudinal axis L which extends through the forefoot, midfoot, and hind foot areas and can further be divided into a proximal and distal half (the proximal and distal halves being medial and lateral halves, respectively). The proximal half is located on the side of the longitudinal axis L that includes the arch area D, while the distal half is located on the other side of the longitudinal axis L.

Figure 2:
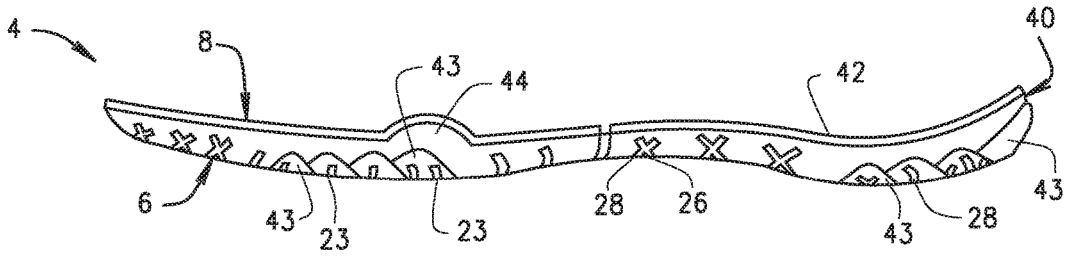
FIG. 2 is a side elevation view of the outsole of FIG. 1.
Figure 3:
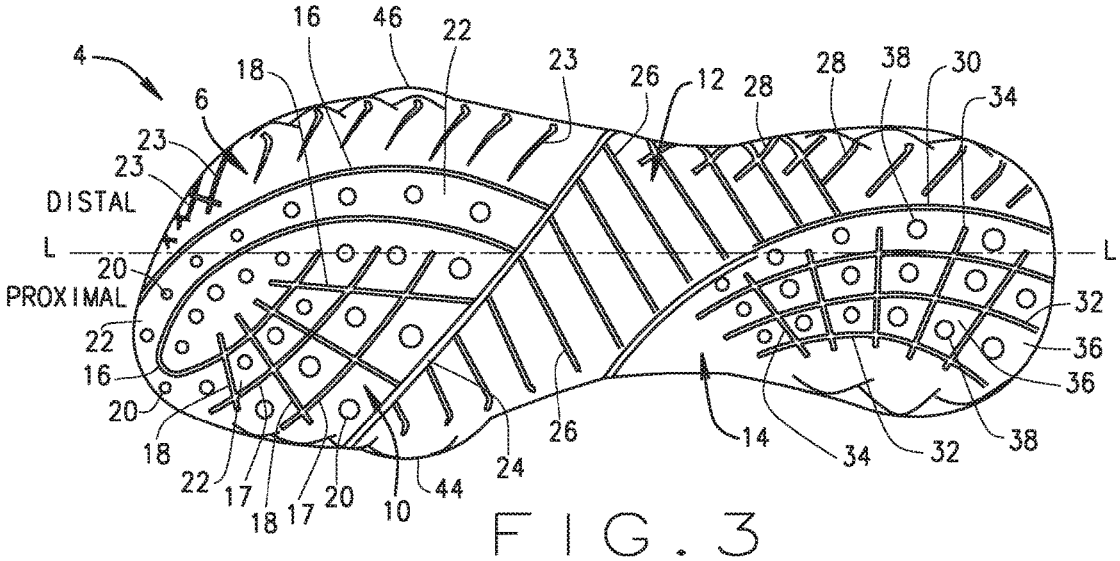
FIG. 3 is a bottom plan view of the outsole of FIGS. 1 and 2.
Figure 4:
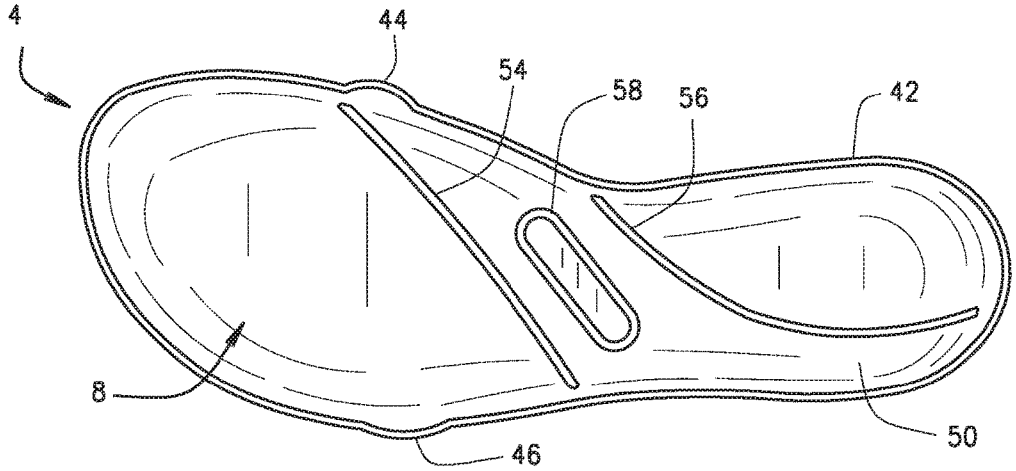
FIG. 4 is a top plan view of the outsole of FIGS. 1-3.

The present outsole 4 is made out of a super lightweight thermoplastic rubber (TPR) and has an exterior face 6 and an interior face 8 as seen in FIGS. 2-4. The exterior face 6 of the outsole 4 engages with the ground or other walking surfaces, while the interior face 8 has a mating relationship with the midsole 60 as will be hereinafter described in more detail.

Figure 7:
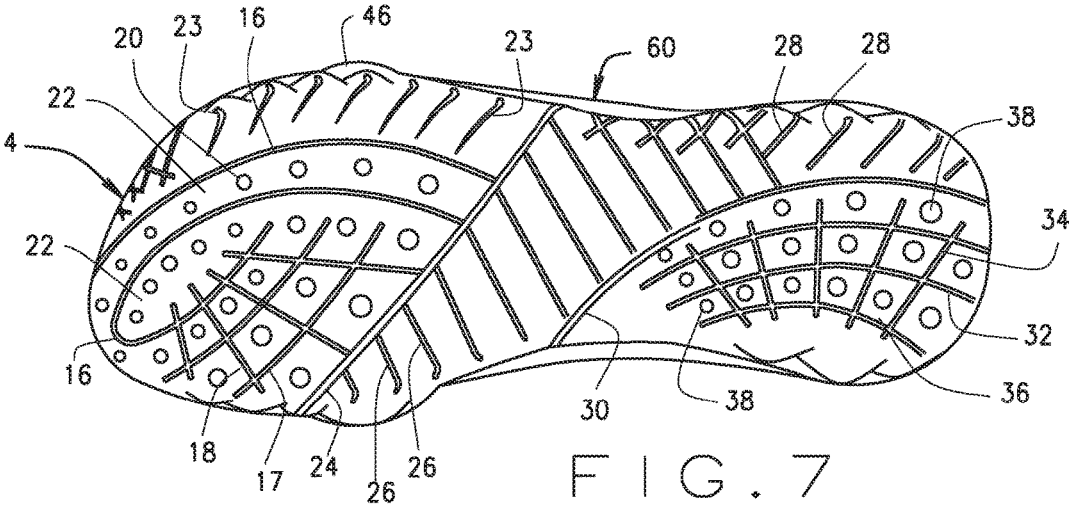
FIG. 7 is a bottom plan view of the outsole and midsole of FIGS. 1-6 mated together.

In one embodiment, the exterior face 6 of the outsole 4 has a first section 10, a second section 12, and a third section 14 as best illustrated in FIGS. 3 and 7. The first section 10 includes portions of the forefoot and midfoot areas. In one embodiment, the first section 10 includes the majority of the forefoot area and extends from the proximal side of the forefoot area to the distal side of the midfoot area. The first section 10 further includes a first plurality of curved or non-linear grooves 16 which start out extending somewhat along the longitudinal axis L before curving downwards towards the proximal side as illustrated in FIG. 3 and at least one of the grooves 16 continuing to turn back towards the distal side of the outsole. The first section 10 also includes a second plurality of curved grooves 17 which extend from the proximal side towards the distal side of the outsole and a third plurality of straight grooves 18 which extend in a direction so as to intersect a portion of the plurality of grooves 16 and 17. At least one of the straight grooves 18 extends substantially along the longitudinal axis of the outsole.

The first section 10 also includes a plurality of circular shaped apertures or cavities 20 which are located and positioned in the raised spaces or areas 22 in between the plurality of grooves 16, 17 and 18. The first section 10 further includes a plurality of grooves 23 located and positioned at the distal side of the first section 10. The first section 10 is divided from the second section 12 by a first angled groove 24. The first angled groove 24 extends upwardly from the proximal side of the forefoot area towards and into the distal side of the forefoot area.

The second section 12 includes portions of the forefoot, midfoot, and hind foot areas. More specifically, the second section 12 includes the majority of the midfoot area and extends from the midfoot area into and towards the proximal side of the forefoot area and also extends in an opposite direction into and towards the distal side of the hind foot area. The second section 12 further includes a first series of diagonal grooves 26 and a second series of diagonal grooves 28. The first series of diagonal grooves 26 is located and positioned approximately throughout the forefoot, midfoot, and a portion of the hind foot areas and extend downwardly at an angle relative to the longitudinal axis in a direction from the distal side to the proximal side of the outsole. The second series of diagonal grooves 28 is located and positioned at the distal side of the second section and are positioned and located at a different angle as compared to the first series of diagonal grooves 26 as best shown in FIGS. 3 and 7. The second section 12 is divided from the third section 14 by a first non-linear groove 30 which extends from the heel area of the hind foot area towards the proximal side of the midfoot area.

The third section 14 includes portions of the midfoot and hind foot areas. More specifically, the third section 14 is located approximately in the hind foot area and extends towards and to the proximal side of the midfoot area. Similar to the first section 10, the third section 14 further includes a first plurality of curved grooves 32 extending from the hind foot area into the midfoot area and a second plurality of straight grooves 34. The second plurality of straight grooves 34 extend primarily across the third section 14 and intersect with the first plurality of curved grooves 32, this intersection of grooves 32 and 34 forming a plurality of raised spaces or areas 36 each of which includes a circular shaped aperture or cavity 38, similar to the plurality of circular shaped apertures/cavities 20 in the first section 10.

The outsole 4 further includes a sidewall 40 which extends around the entirety of the perimeter of the outsole 4 as shown in FIG. 2 and includes a first raised lip or edge portion 42 which projects away from the interior face 8 of the outsole 4 forming a first cavity 50 as will be hereinafter further explained. The sidewall 40 further includes a plurality of raised triangularly shaped projections 43 in the forefoot and hind foot areas that provide increased stability and support to the outsole when mated with the midsole 60. Similarly, a first protrusion 44 and a second protrusion 46 located and positioned in the general area of the midfoot area on opposite sides of the sidewall 40 as best illustrated in FIG. 4 also increase stability and provide support to the midsole 60 when the outsole 4 is mated with the midsole 60 as will be hereinafter explained.

Turning to FIG. 4, the lip 42 which surrounds the entire circumference of the interior face 8 of the outsole 4 creates the first cavity 50 substantially in the same shape as the outsole 4. The cavity 50 of the outsole 4 has a mating relationship with the midsole 60 which will be hereinafter explained. The interior face 8 of the outsole 4 further includes a raised angled projection 54, a raised non-linear projection 56, and a raised oval shaped projection 58, wherein the raised angled projection 54 and raised non-linear projection 56 correspond respectively to the first angled groove 24 and first non-linear groove 30 on the exterior face 6 of the outsole 4 thereby allowing the exterior face 6 of the outsole 4 to have deeper grooves and to have a hinge-like function which improves flexibility. The deeper grooves formed by the raised angled projection 54 and the raised non-linear projection 56 also function in conjunction with the grooves 16, 17 and 18, 26, 28, 32 and 34 to help dissipate and displace water or other liquids off of the exterior surface 6 of the outsole 4 when walking on wet surfaces. These plurality of grooves create flow channels that help to guide water or other liquids off of the exterior face 6 thereby preventing the outer surface 6 from becoming slippery.

Figure 5:
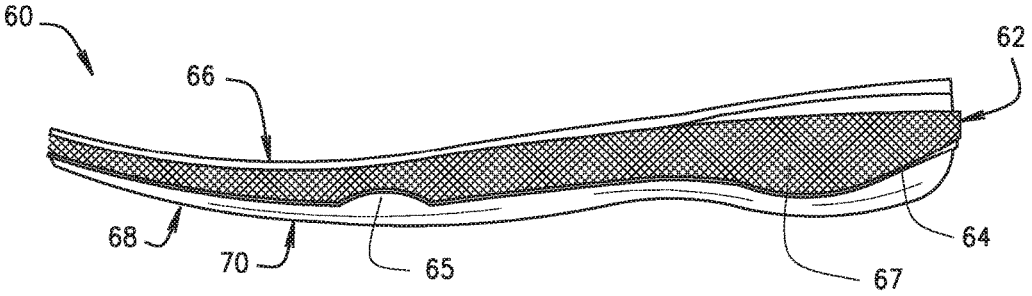
FIG. 5 is a side elevation view of the midsole of FIG. 1.
Figure 8:
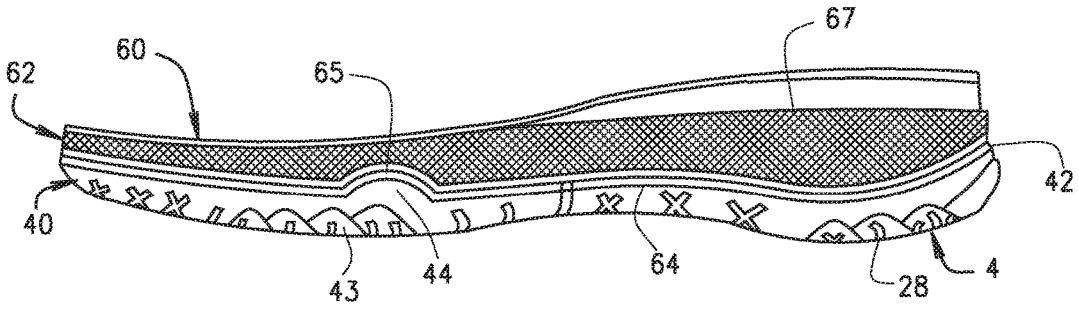
FIG. 8 is side elevation view of the outsole and midsole of FIG. 7 mated together.
Figure 9:
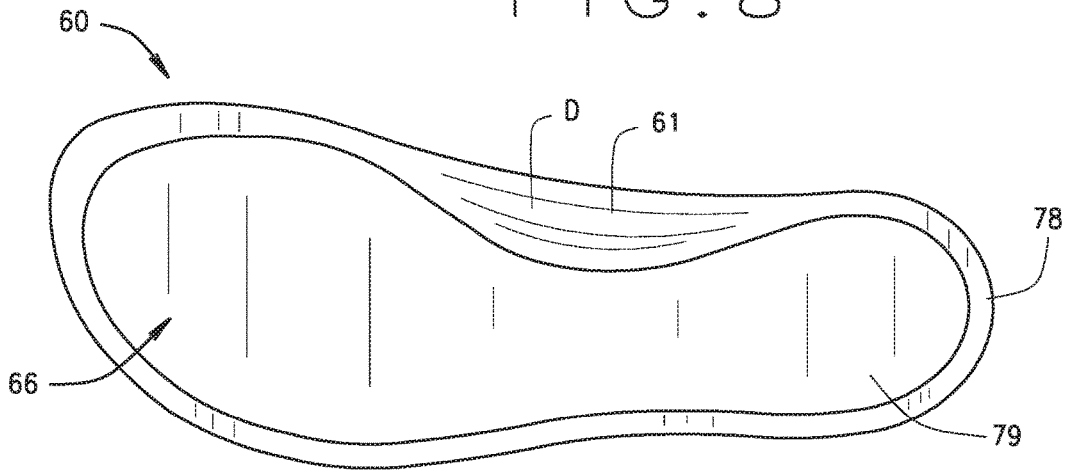
FIG. 9 is a top plan view of the midsole of FIGS. 1, 5, and 6.
Figure 10:
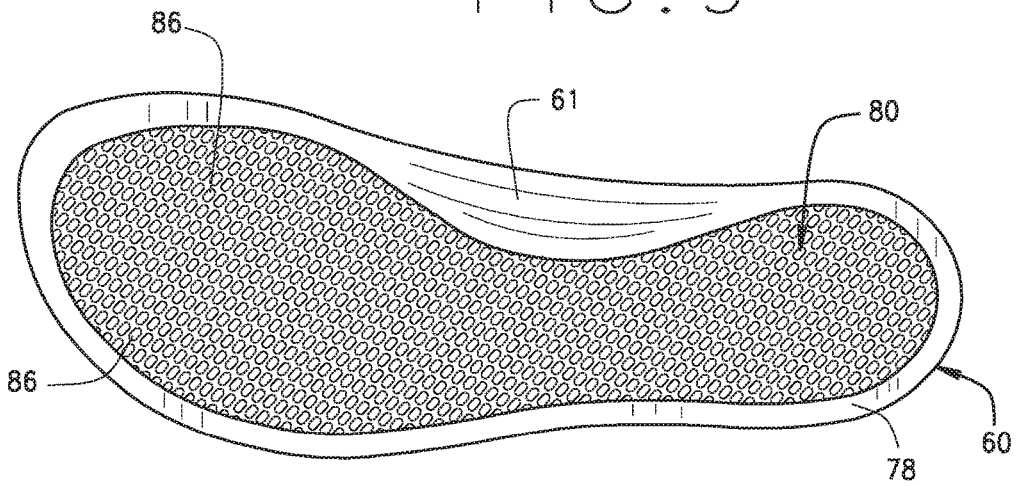
FIG. 10 is a top plan view of the midsole and insole of FIGS. 1, 5, 6, and 9 mated together.

The present midsole 60 is made of a dual density blown ethylene-vinyl acetate copolymer (EVA) with an intrinsic molded arch support 61 which supports the arch area D of the foot as best illustrated in FIGS. 1, 9, and 10. The EVA creates a lightweight and resilient midsole 60 which helps dissipate shock when walking or running. In addition to the material itself, the dual density of the midsole 60 allows for greater flexibility and cushioning in the forefoot area due to its lighter density, and provides greater support and stability in the hind foot area due to its heavier density. The midsole includes a sidewall 62 and a corresponding ridge or side protrusion 64 both of which extend completely around the perimeter of the midsole 60 as shown in FIGS. 5 and 8. The corresponding ridge 64 is located and positioned on the sidewall 62 so as to be adjacent to the raised lip or edge portion 42 of the outsole 4 when the outsole 4 and midsole 60 are mated together. The corresponding ridge 64 likewise includes a pair of concave ridge portions or recesses 65 which are positioned and located so as to mate with the first and second protrusions 44 and 46 associated with the outsole 4. This engagement of the protrusions 44 and 46 with the concave ridge portions 65 provide improved support and stability to the mating of the outsole 4 with the midsole 60. The sidewall 62 further includes a raised scored pattern 67 as best shown in FIGS. 1, 5, and 8. In one embodiment, the scored pattern 67 is diamond shaped and absorbs and dissipates shock.

Figure 6:
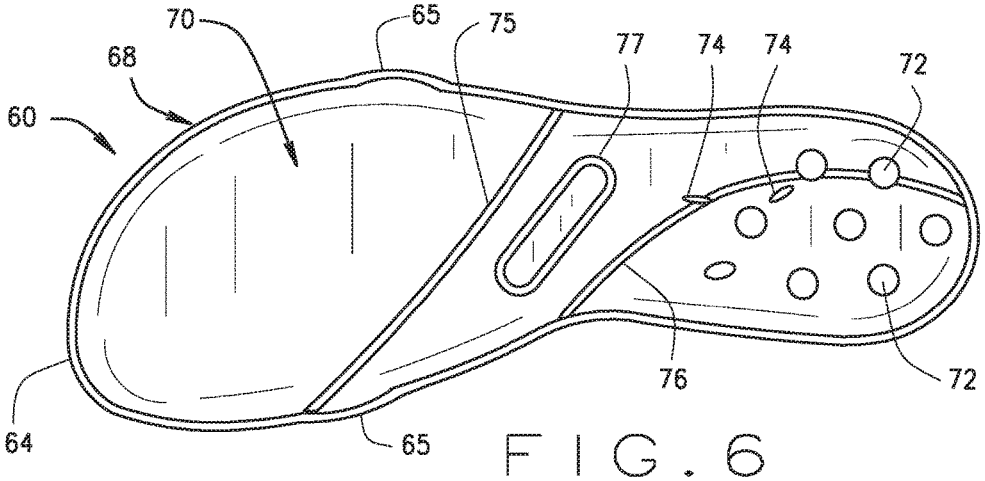
FIG. 6 is bottom plan view of the midsole of FIGS. 1 and 5.

Referring to FIGS. 5 and 6, the midsole 60 has a proximal face 66 and distal face 68. The distal face 68 has a protrusion or raised area 70 substantially in the shape of the outsole 4 which corresponds to the first cavity 50 in the outsole 4. The raised area 70 on the distal face 68 has a plurality of circular shaped apertures or cavities 72 and a plurality of raindrop shaped apertures or cavities 74 to reduce the weight of the midsole thereby increasing comfort and improving breathability when the present shoe is worn. The plurality of circular shaped apertures/cavities 72 and raindrop shaped apertures/cavities 74 also increase flexibility, cushioning, and create a bounce effect. The plurality of circular shaped apertures/cavities 72 and plurality of raindrop shaped apertures/cavities 74 are located and positioned in spaced apart relationship to one another and are located approximately in the hind foot area. The distal face 68 of the midsole 60 further includes a second angled groove 75, a second non-linear groove 76, and an oval shaped groove 77 which correspond to the raised angled projection 54, the raised non-linear projection 56, and the raised oval shaped projection 58 on the interior face 8 of the outsole 4. The corresponding relationship of grooves 75, 76, and 77 to the first angled groove 24, the first non-linear groove 30, the raised angled projection 54, the raised non-linear projection 56, and the oval shaped raised projection 58 combine to allow for a hinge-like motion to increase flexibility and comfort in the present shoe.

The midsole 60 has a mating relationship with the outsole 4 wherein the area protrusion 70 on the distal face 68 of the midsole 60 mates with and is received by the first cavity 50 on the interior face 8 of the outsole 4 as best illustrated in FIGS. 7 and 8. The insole 80 also has a mating relationship to the midsole 60 wherein the proximal face 66 of the midsole 60 has a lip or flange 78 extending around its circumference creating a second cavity 79 substantially in the shape of the insole 80 as shown in FIG. 9. Turning to FIG. 10, the insole 80 mates with and is received by the second cavity 79 of the midsole 60. The three layers are preferably secured together to prevent movement when worn.

Figure 11:
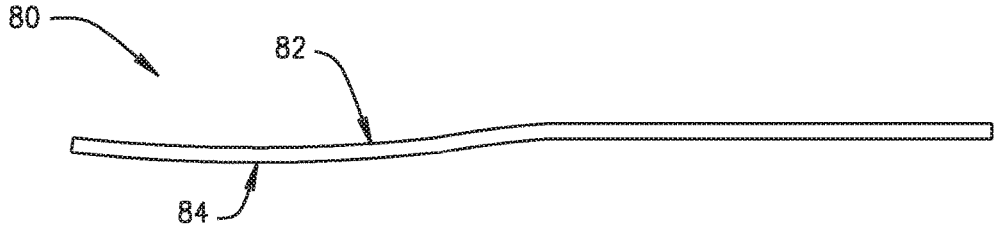
FIG. 11 is a side elevation view of the insole of FIG. 1.
Figure 12:
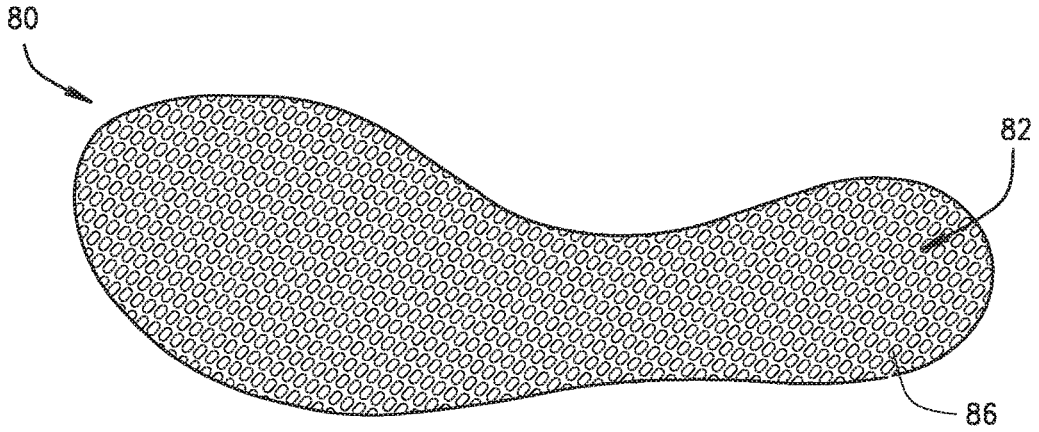
FIG. 12 is a top plan view of the insole of FIGS. 1 and 11.
Figure 13:
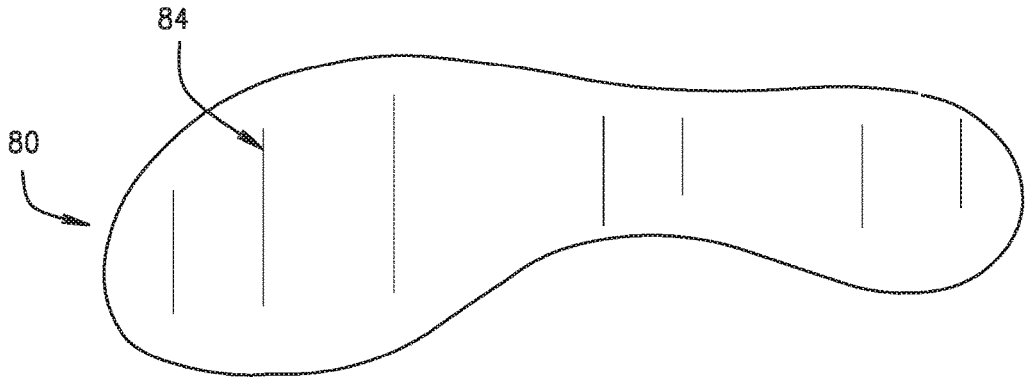
FIG. 13 is a bottom plan view of the insole of FIGS. 1, 11, and 12.

The insole 80 is a lightweight, thermal molded EVA as best illustrated in FIGS. 1 and 11-13. The insole 80 also has an antimicrobial shield which provides protection against bacteria, fungus, and controls or eliminates odors, stains, and product deterioration. This can be accomplished by adding a powder or other antimicrobial agents during the manufacturing process. As shown in FIGS. 11-13, the insole has a top face 82 and a bottom face 84 wherein the top face 82 engages with the foot of a wearer and includes a plurality of raised oval shaped projections 86 that provide for a bubble type effect which enhances cushioning and air circulation when the shoe is worn. In one embodiment, the raised oval projections 86 cover the entire top face 82 of the insole 84 as best illustrated in FIGS. 1, 10, and 12. Turning to FIG. 13, the bottom face 58 of the insole is substantially smooth.

The present three layer shoe construction absorbs shock, enhances comfort, creates a unique bounce effect, without requiring a vast number of components, and provides numerous grooves or flow channels on the exterior face 6 of the outsole for water or liquid displacement when walking on a slippery surface.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A shoe construction comprising:

an outsole having an exterior face, an interior face, a first sidewall, a medial side, a lateral side, an arch portion, a forefoot area, a midfoot area, and a hind foot area, the exterior face of the outsole including a first section, a second section, and a third section, the first section being located and positioned in the forefoot area and extends in from the medial side of the forefoot area to the lateral side of the midfoot area, the second section being located and positioned adjacent to the first section and includes a portion of the midfoot area and extends on opposite sides into the medial side of the forefoot area and into the lateral side of the hind foot area, the third section being located and positioned adjacent to the second section and extending from the hind foot area towards and into the midfoot area, the first section including a first plurality of non-linear grooves, a second plurality of curved grooves, a third plurality of straight grooves, and a plurality of circular shaped cavities, the second section including a first series of diagonal grooves and a second series of diagonal grooves, the third section including a first plurality of curved grooves, a second plurality of straight grooves, and a plurality of cavities, the first and second sections being separated by a first angled groove and the second and third sections being separated by a first non-linear groove, the first sidewall extending around a perimeter of the interior face of the outsole and including a lip, said first sidewall forming a first cavity located and positioned on the interior face, the interior face further including a raised angled projection and a raised non-linear projection, wherein the raised angled projection and the raised non-linear projection are located and positioned on the interior face in a corresponding relationship with the first angled groove and the first non-linear groove on the exterior face of the outsole;

a midsole having a proximal face, a distal face, a second sidewall, a forefoot area, a midfoot area and a hind foot area, the midsole having a first density in the forefoot area and a second density in the hind foot area, the second sidewall including a corresponding ridge for mating with the lip of the first sidewall of the outsole, the distal face of the midsole including a projected area, the projected area including a second angled groove and a second non-linear groove located and positioned in a corresponding relationship with the raised angled projection and the raised non-linear projection on the interior face of the outsole, the proximal face of the midsole having a second cavity; and an insole having a top face and a bottom face, the top face of the insole including a plurality of raised projections;

the first cavity on the interior face of the outsole being shaped and dimensioned to receive the projected area on the distal face of the midsole and the second cavity on the proximal face of the midsole being shaped and dimensioned to receive the insole.

2. The shoe construction of claim 1 wherein the lip of the first sidewall on the outsole includes a first protrusion and a second protrusion positioned and located respectively on the opposite sides of the first sidewall and the corresponding ridge of the second sidewall on the midsole includes a pair of recesses for mating with the first and second protrusions associated with the lip of the first sidewall of the outsole when the outsole and midsole are coupled together.

3. The shoe construction of claim 1 wherein the first sidewall on the outsole includes a plurality of raised triangularly shaped projections located and positioned in the forefoot and hind foot areas.

4. The shoe construction of claim 1 wherein the projected area on the distal face of the midsole includes a plurality of circular shaped apertures and a plurality of raindrop shaped apertures located and positioned in the hind foot area.

5. The shoe construction of claim 1 wherein the first plurality of curved grooves in the third section of the outsole intersect with the second plurality of straight grooves in the third section of the outsole thereby forming a plurality of projected spaces on the exterior face of the outsole, at least some of the plurality of cavities associated with the third section of the outsole being located in the plurality of projected spaces.

6. The shoe construction of claim 1 wherein the proximal face of the midsole further includes a molded arch support.

7. The shoe construction of claim 1 wherein the plurality of raised projections on the top face of the insole includes a plurality of raised oval shaped projections.

8. The shoe construction of claim 1 wherein the outsole is made of a lightweight thermoplastic rubber.

9. The shoe construction of claim 1 wherein the midsole is made of an ethylene-vinyl acetate copolymer.

10. The shoe construction of claim 1 wherein the insole is made of a lightweight, thermal molded ethylene-vinyl acetate copolymer.

11. The shoe construction of claim 1 wherein the interior face of the outsole further includes a projected oval shaped projection for mating with an oval shaped groove located on the raised area of the distal face of the midsole.

12. The shoe construction of claim 1 wherein at least portions of at least some of the first and second plurality of grooves in the first section of the exterior face of the outsole intersect with at least some of the third plurality of straight grooves in the first section of the exterior face of the outsole.

13. The shoe construction of claim 1 wherein the first section of the exterior face of the outsole includes a plurality of projected areas in between at least some of said first, second and third plurality of grooves associated with said first section, at least some of said plurality of circular shaped cavities associated with said first section being located on said plurality of projected areas.

14. A shoe construction comprising:

an outsole having an exterior face, an interior face, a first sidewall, a medial side, a lateral side, an arch portion, a forefoot area, a midfoot area, and a hind foot area, the exterior face of the outsole including a first section, a second section, and a third section, the first section being located and positioned in the forefoot area and extending from the medial side of the forefoot area to the lateral side of the midfoot area, the second section being located and positioned adjacent to the first section and includes a portion of the midfoot area and extending on opposite sides into the medial side of the forefoot area and into the lateral side of the hind foot area, the third section being located and positioned adjacent to the second section and extending from the hind foot area towards and into the midfoot area, the first section including a first plurality of curved grooves, a second plurality of straight grooves, and a plurality of circularly shaped cavities, at least some of the second plurality of straight grooves intersecting at least some of said first plurality of curved grooves, the second section including a first series of diagonal grooves and a second series of diagonal grooves, the third section including a first plurality of curved grooves intersected by a second plurality of straight grooves, and a plurality of circularly shaped cavities, a first angled groove on the exterior face separating the first section from the second section and a first non-linear groove on the exterior face separating the second section from the third section, the first sidewall extending around a periphery of the outsole forming a first cavity on the interior face of the outsole, the first sidewall including a first protrusion and a second protrusion located and positioned respectively on opposite sides of the first sidewall, the interior face further including a raised angled projection and a raised non-linear projection, wherein the raised angled projection and the raised non-linear projection are located and positioned on the interior face in a corresponding relationship with the first angled groove and the first non-linear groove on the exterior face of the outsole;

a midsole having a proximal face, a distal face, a second sidewall, a forefoot area, a midfoot area and a hind foot area, the midsole having a first density in the forefoot area and a second density in the hind foot area, the second density being greater than the first density, the second sidewall including a raised scored pattern and a corresponding ridge for mating with the first sidewall of the outsole, the second sidewall further including a pair of recesses for mating with the first and second protrusions of the first sidewall when the outsole is mated with the midsole, the distal face including a projected area for mating with the first cavity on the interior face of the outsole, the projected area of the distal face further including a second angled groove and a second non-linear groove located and positioned in a corresponding relationship with the raised angled projection and the raised non-linear projection on the interior face of the outsole, the proximal face of the midsole including a second cavity and a molded arch support; and an insole having a top face and a bottom face, the top face of the insole including a plurality of raised projections;

the first cavity on the interior face of the outsole being shaped and dimensioned to receive the projected area on the distal face of the midsole and the second cavity on the proximal face of the midsole being shaped and dimensioned to receive the insole.

15. The shoe construction of claim 14 wherein the projected area on the distal face of the midsole includes a plurality of circularly shaped cavities positioned and located in the hind foot area.

16. The shoe construction of claim 14 wherein the plurality of raised projections on the top face of the insole includes a plurality of raised oval shaped projections.

17. The shoe construction of claim 14 wherein the first sidewall on the outsole includes a plurality of raised triangularly shaped projections in the forefoot and hind foot areas.

18. A shoe construction comprising:

an outsole having an exterior face, an interior face, a first sidewall, a medial side, a lateral side, an arch portion, a forefoot area, a midfoot area, and a hind foot area, the exterior face of the outsole including a first section, a second section, and a third section, the first section being located and positioned in the forefoot area and extends from the medial side of the forefoot area to the lateral side of the midfoot area, the second section being located and positioned adjacent to the first section and includes a portion of the midfoot area and extends on opposite sides thereof into the medial side of the forefoot area and into the lateral side of the hind foot area, the third section being located and positioned adjacent to the second section and extends from the hind foot area towards and into the midfoot area, the first section including a first plurality of curved grooves, a second plurality of straight grooves, and a plurality of circularly shaped cavities, said first and second pluralities of grooves forming a plurality of projected areas therebetween, said plurality of circularly shaped cavities being located within said plurality of projected areas, said first section further including a third plurality of grooves extending from the distal side of the first section, the second section including a first series of diagonal grooves and a second series of diagonal grooves, the second series of diagonal grooved areas being positioned and located at a different angle as compared to the first series of diagonal grooves, the third section including a first plurality of curved grooves positioned and located so as to intersect a second plurality of straight grooves, the intersection of the first and second plurality of grooves of the third section forming a plurality of projected areas therebetween, each projected area including a circularly shaped cavity, the first and second sections being separated by a first angled groove and the second and third sections being separated by a first non-linear groove, the first sidewall forming a first cavity on the interior face of the outsole and including a first protrusion and a second protrusion located and positioned on opposite sides of the first sidewall, the interior face of the outsole further including a raised angled projection, a raised non-linear projection, and a raised oval shaped projection, wherein the raised angled projection and the raised non-linear projection are located and positioned on the interior face in a corresponding relationship with the first angled groove and first non-linear groove on the exterior face of the outsole and the raised oval shaped projection being located and positioned in the midfoot area;

a midsole having a proximal face, a distal face, a second sidewall, a forefoot area, a midfoot area and a hind foot area, the midsole having a first density in the forefoot area and a second density in the hind foot area, the second density being greater than the first density, the second sidewall including a raised scored pattern and a corresponding ridge for mating with the first sidewall of the outsole, the second sidewall further including a pair of concave ridge portions for mating with the first and second protrusions of the first sidewall when the outsole is mated with the midsole, the distal face of the midsole including a projected area having a plurality of circularly shaped cavities and a plurality of raindrop shaped cavities located and positioned in the hind foot area, the projected area of the distal face further including a second angled groove, a second non-linear groove, and an oval shaped groove located and positioned in a corresponding relationship with the raised angled projection, the raised non-linear projection, and the raised oval shaped projection on the interior face of the outsole, the proximal face of the midsole including a second cavity and a molded arch support; and an insole having a top face and a bottom face, the top face of the insole including a plurality of raised projections;

the first cavity on the interior face of the outsole being shaped and dimensioned to receive the projected area on the distal face of the midsole and the second cavity on the proximal face of the midsole being shaped and dimensioned to receive the insole.

19. The shoe construction of claim 18 wherein the plurality of raised projections on the top face of the insole includes a plurality of raised oval shaped projections.

20. The shoe construction of claim 19 wherein at least the top face of the insole includes an antimicrobial agent.

* * * * *